US006877280B2

(12) United States Patent
Yokomori

(10) Patent No.: US 6,877,280 B2
(45) Date of Patent: Apr. 12, 2005

(54) METHOD OF SLIDING A VEHICLE DOOR BY A POWERED SLIDING DOOR

(75) Inventor: Kazuhito Yokomori, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/270,717

(22) Filed: Oct. 16, 2002

(65) Prior Publication Data

US 2004/0103585 A1 Jun. 3, 2004

(30) Foreign Application Priority Data

Oct. 16, 2001 (JP) ..... 2001-317645

(51) Int. Cl.[7] ..... E06B 3/00
(52) U.S. Cl. ..... 49/506
(58) Field of Search ..... 49/26, 27, 28, 49/360, 506; 318/280, 283, 284, 285, 445, 452

(56) References Cited

U.S. PATENT DOCUMENTS 5,396,158 A * 3/1995 Long et al. ..... 318/282
6,164,015 A * 12/2000 Kawanobe et al. ..... 49/360
6,208,102 B1 * 3/2001 Kikuchi et al. ..... 318/466
6,359,762 B1 3/2002 Yokomori
6,580,243 B2 * 6/2003 Itami et al. ..... 318/452

FOREIGN PATENT DOCUMENTS

JP 2001180271 A * 7/2001 ..... B60J/5/00

* cited by examiner

*Primary Examiner*—Jerry Redman
(74) *Attorney, Agent, or Firm*—Browdy and Neimark, P.L.L.C.

(57) ABSTRACT

A control method of a powered sliding device for sliding a vehicle sliding door slidably attached to a vehicle body with the power of a motor in the door opening direction and in the door closing direction, wherein when a first abnormal sliding of the sliding door is detected during the door closing sliding of the sliding door by the door closing rotation of the motor, the motor is rotated again in the door closing direction after being stopped for a specified time, and after that, the re-judgment of the abnormal sliding is performed, and when the abnormal sliding is again detected in the re-judgment, safety processing operation is performed.

1 Claim, 4 Drawing Sheets

METHOD OF SLIDING A VEHICLE DOOR BY A POWERED SLIDING DOOR

FIELD OF THE INVENTION

The present invention relates to a control method of sliding a vehicle door by a powered sliding device, and particularly, relates to the safety control for detecting an abnormal sliding of a sliding door.

DESCRIPTION OF THE RELATED ART

Conventionally, powered sliding devices for a vehicle sliding door have been well known, which slide a sliding door in the door closing direction and door opening direction by rotating a wire drum connected to the sliding door through a wire cable by the power of a motor. These conventional sliding devices have a safety control for dealing with an accident (abnormal sliding) of having a body of an operator or a baggage held between the vehicle body and the door or the like. When detecting occurrence of an abnormal sliding, the safety control stops the door or moves the door in the reverse direction, so that the damage because of the abnormal sliding is reduced.

Almost all of the conventional safety controls are set to detect an abnormal sliding by monitoring the current value (load) of an electric motor of the powered sliding device or monitoring the change of sliding speed of the sliding door. In the safety control, how the reference value for detecting an abnormal sliding is set is important. Generally, when supposing a situation where a large load is applied to the sliding door, the reference value is loosely set to dull the sensitivity of the safety control, and on the contrary, when the load is small, the reference value is severely set to sharpen the sensitivity of the safety control.

When the vehicle starts while sliding the sliding door in the door closing direction by the powered sliding device, the controller of the sliding device usually slides the sliding door until the door closing of the sliding door is finished. The reason is that it takes priority to completely shut the sliding door and achieve the safety of the person in the vehicle during the running of the vehicle.

When the sliding door is sliding in the door closing direction, if the vehicle starts, the accelerating gravity of the vehicle which becomes the sliding resistance is given to the sliding door. The accelerating gravity of the vehicle reduces the sliding speed of the sliding door, and brings a large load to the motor. Then, in some cases, the safety control may wrongly detect such changes of sliding speed or changes of load of the motor as an abnormal sliding.

Therefore, conventionally, it is arranged that when the vehicle is running, the reference value of the safety control is made loose, so that the change of the sliding speed because of the accelerating gravity of the vehicle or the change of the load of the motor is not detected as an abnormal sliding. However, if the reference value is made loose, such a problem that the detection of a true accident is delayed is caused.

SUMMARY OF THE INVENTION

Accordingly, it is an object of the present invention to provide a safety control wherein the influence because of the accelerating gravity of the vehicle is reduced.

DESCRIPTION OF THE PREFERRED EMBODIMENT

Figure 1:
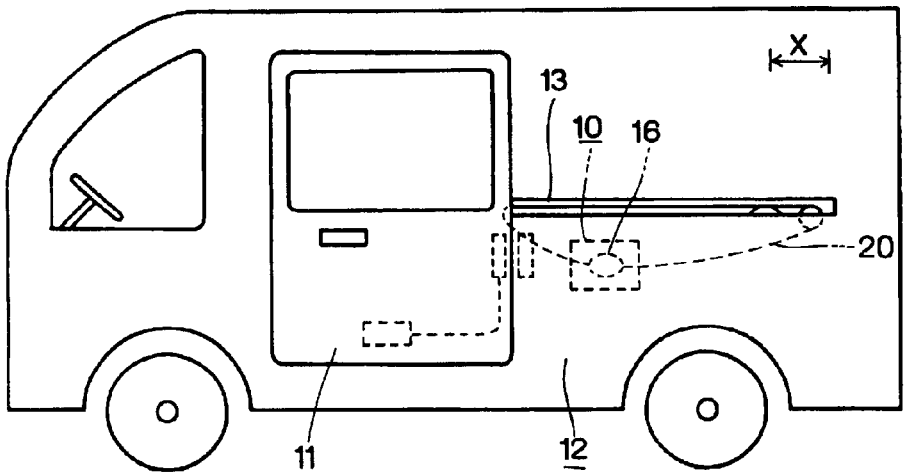
FIG. 1 is a side view of a vehicle with a powered sliding device and a sliding door.
Figure 2:
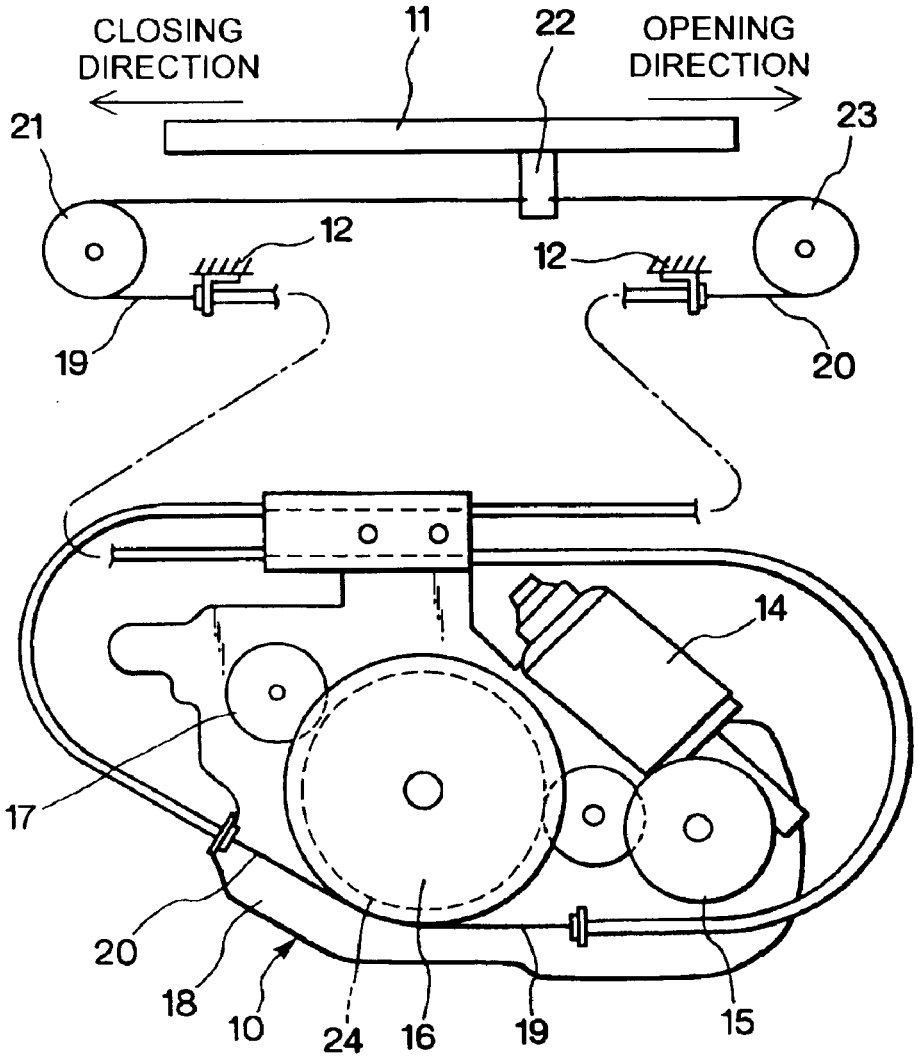
FIG. 2 is an expansion plan of the sliding device and the sliding door.

One preferred embodiment of the present invention will be described by using drawings. FIG. 1 shows the rough relation between a powered sliding device 10 according to the present invention and a vehicle sliding door 11 which slides in the door closing direction and the door opening direction by the powered sliding device 10, and FIG. 2 shows the expanded relation of both.

The sliding door 11 is slidably attached to a vehicle body 12, and slides in the back and forth direction of the vehicle body 12 along a guide rail 13 provided to the vehicle body 12. The sliding device 10 has a motor 14, a reduction mechanism 15, a wire drum 16, and an auxiliary brake 17, and these are attached to a base plate 18 fixed to the vehicle body 12. The auxiliary brake 17 has electrical control parts such as a solenoid, and when it operates, it gives rotational resistance to the wire drum 16.

To the wire drum 16, one end sides of two wire cables 19, 20 are connected. The other end side of the first cable 19 is connected to a bracket 22 of the sliding door 11 through a front pulley 21 pivoted to the vehicle body 12. Similarly, the other end side of the second cable 20 is connected to the bracket 22 through a rear pulley 23 pivoted to the vehicle body 12.

Between the reduction mechanism 15 and the wire drum 16, a clutch mechanism 24 is provided, and the rotation of the motor 14 is transmitted to the wire drum through the reduction mechanism 15 and the clutch mechanism 24. The structure of the clutch mechanism 24 is free. For example, it is possible to use an electromagnetic clutch which can be switched to the connected state and the disconnected state between the motor 14 and the wire drum 16 by the operation of an electromagnet, or a clutch which is switched to the connected state when the motor 14 rotates, and is switched to the disconnected state when the motor 14 stops, or a clutch which is switched to the connected state by the rotation of the motor but which can keep the connected state even if the motor 14 is stopped, or the like (refer to U.S. Pat. No. 6,359,762).

When the wire drum 16 rotates clockwise by the power of the motor 14, the first wire cable 19 is wound up, and at the same time, the second wire cable 20 is pulled out, and the sliding door 11 slides in the door closing direction, and by the counterclockwise rotation of the wire drum 16, the second wire cable 20 is wound up, and at the same time, the first wire cable 19 is pulled out, and the sliding door 11 slides in the door opening direction.

Figure 3:
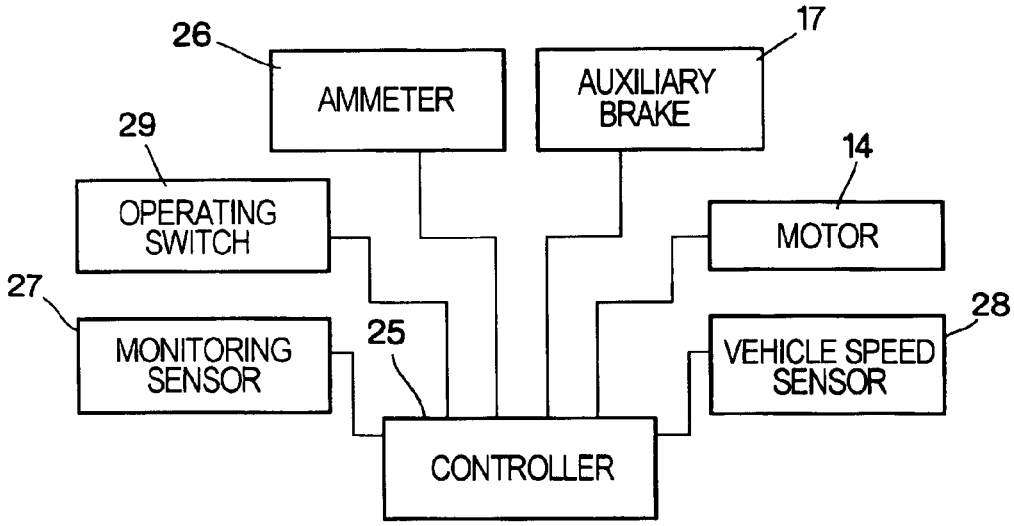
FIG. 3 is a block diagram for performing the control operation of the present invention.

FIG. 3 is a block diagram for performing the control operation according to the present invention. The block circuit has a controller 25, an ammeter (motor load detector) 26 for measuring the current flowing in the motor 14, a sliding speed monitoring sensor 27 for detecting the sliding speed of the sliding door 11, a vehicle speed sensor 28, and an operating switch 29.

OPERATIONS

Figure 4:
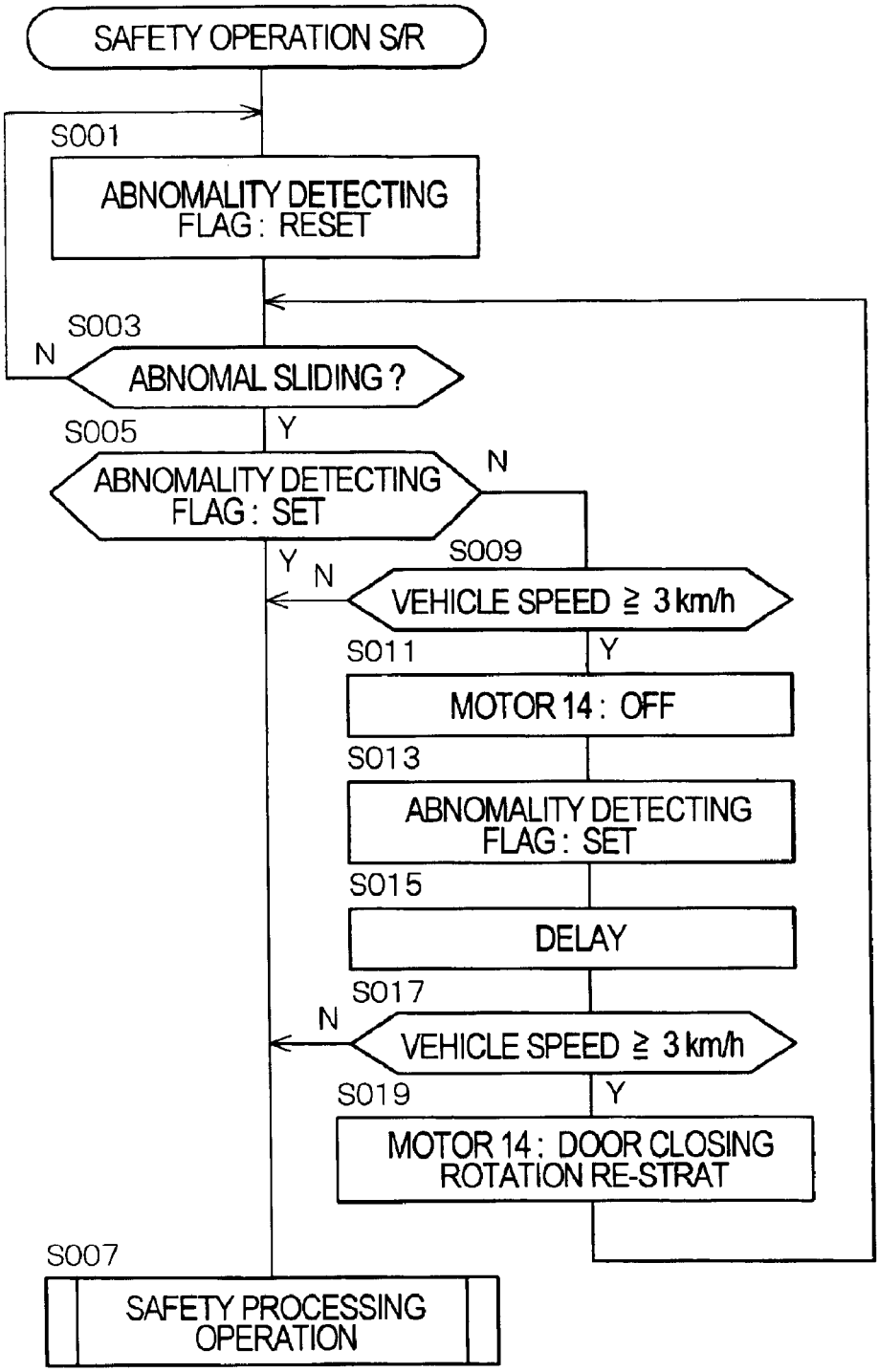
FIG. 4 is a flow chart showing the subroutine of the safety operation.

When the operating switch 29 is operated to the door closing side, the door closing operation of the sliding control is performed by the controller 25, and the wire drum 16 rotates in the door closing direction by the motor 14, and the sliding door 11 starts to slide in the door closing direction. Furthermore, the controller 25 performs the safety operation shown in FIG. 4 for monitoring the abnormal sliding of the sliding door 11 during the door closing operation.

In the safety operation, first, the abnormality detecting flag is reset in advance (S001), and the motor load to be measured by the ammeter 26 or the changing width of the sliding speed of the sliding door 11 measured by the sliding speed monitoring sensor 27 is compared with reference value to monitor the abnormal sliding of the sliding door 11 (S003). The reference value at this moment is the reference value to be used in the state where the vehicle is stopping, and in the setting of the reference value, it is unnecessary to consider the effects by the starting or the running of the vehicle. Furthermore, it is preferable condition to perform both the monitoring of the motor load and the monitoring of the sliding speed, and the safety control can be performed only by any one of them.

In the step S003, when the first abnormal sliding is detected, and when the abnormality detecting flag has not been set (S005), the running state of the vehicle is checked by the vehicle speed sensor 28 (S009). At this moment, if the vehicle is in the stopping state, it is possible to judge that an abnormal sliding because of the occurrence of an actual accident is caused, and therefore, according to the safety processing operation, the motor 14 is immediately stopped, or the motor 14 is reversed in the door opening direction (S007). Furthermore, even when the vehicle is in the running state, if the speed thereof is slower than a specified speed (about 3 km/h), the effect acted on the sliding door 11 by the accelerating gravity of the vehicle is small, and therefore, similarly, it is possible to judge that an accident has actually happened. Therefore, when the vehicle speed at the time of detection of the abnormal sliding is less than 3 km/h (S009), the safety processing operation is uniformly performed (S007).

However, even if the first abnormal sliding is detected in the step S003, when the vehicle speed is a specified speed or more in the step S009, it is difficult to immediately judge whether the abnormal sliding is caused by the accelerating gravity acted on the sliding door 11 or the abnormal sliding is caused by an actual accident. Therefore, in the case of the present invention, the motor 14 is turned off to stop the sliding door 11 (S011), and the abnormality detecting flag is set (S013), and under this condition, the state is monitored for a specified time (one second) (S015). Furthermore, when the clutch mechanism 24 is a mechanism which cannot stop the sliding door 11 by the turn-off of the motor 14, the auxiliary brake 17 is operated.

When the specified time in the step S015 has passed, the vehicle speed is checked (S017). When it is slower than the specified speed (about 3 km/h) at this moment, it is considered that an actual accident has happened, and the safety processing operation is performed (S007). That is, when the reduction of the vehicle speed is confirmed by the elapse of the specified time, it means either the case where the driver has recognized the occurrence of an accident and has braked the vehicle or the case where there has been only the need for a little moving the vehicle, and in any case, after that, there is no need for sliding the sliding door in the door closing direction. Furthermore, the movement to the safety processing control in this step is performed after about one second has passed since the detection of the first abnormal sliding, and therefore, it may be thought that the meeting step is late, but in the case of the present invention, the reference value to be used for the judgment of the abnormal sliding is the reference value which can also be used even in the stopped state of the vehicle, and therefore, a little abnormal sliding can be detected in an early stage, and it is possible to decrease the damage caused by the accident. On the contrary, as in the past, in the case of a method where the reference value during the running of the vehicle is set loose, it takes a time to detect the occurrence of a true accident, and therefore, the damage caused by the accident is also increased.

After the elapse of the specified time in the step S015, when the vehicle speed is faster than the specified speed (about 3 km/h), the probability of detection of the abnormal sliding because of the accelerating gravity at the time of vehicle start is very large, and therefore, the motor 14 is rotated in the door closing direction, and the door closing sliding of the sliding door 11 is started again (S019), and in the step S003, the judgment of the abnormal sliding is performed again. In this step, one second or more have already passed since the detection of the first abnormal sliding, and the accelerating gravity acted on the sliding door 11 by the start of the vehicle intends to gradually fall after the start, and therefore, when the detection of the first abnormal sliding is performed by the effect of the starting acceleration in the normal range, the abnormal sliding is not detected at the time of re-judgment, and after that, the door closing of the sliding door 11 can be continued.

However, when the abnormal sliding is detected even in the re-judgment, it is proper to consider that an actual accident is caused. Therefore, when the abnormal sliding is detected, if the abnormality detecting flag is set (S005), it means the detection of the abnormal sliding at the time of re-judgment, and therefore, the safety processing operation is immediately performed (S007).

ADVANTAGES

In the case of the present invention, it is possible to accurately detect the abnormal sliding during the door closing of the sliding door 11 in an early stage regardless of the running state of the vehicle.

What is claimed is:

1. A control method of a powered sliding device for sliding a door slidably attached to a vehicle body in a door opening direction and in a door closing direction by power of a motor, wherein when a first abnormal sliding of the door is detected during a closing of the door by a door closing rotation of the motor, a first vehicle speed measurement is performed, and when the first measured vehicle speed measurement is less than a specified speed, a safety processing operation is immediately performed, and when the first vehicle speed measurement is the specified speed or more, a re-measurement of the vehicle speed is performed after stopping the motor for a specified time, and when the re-measurement of the vehicle speed is less than the specified speed, the safety processing operation is immediately performed, and when the re-measurement of the vehicle speed is the specified speed or more, the door closing rotation of the motor is actuated and after that, a re-judgment of the abnormal sliding is performed, and when the abnormal sliding is again detected in the re-judgment, the safety processing operation is performed.

* * * * *